US012180571B2

(12) United States Patent
Cho et al.

(10) Patent No.: US 12,180,571 B2
(45) **Date of Patent: *Dec. 31, 2024**

(54) HIGH-STRENGTH COLD ROLLED STEEL SHEET AND GALVANNEALED STEEL SHEET HAVING EXCELLENT BURRING PROPERTY, AND MANUFACTURING METHOD THEREFOR

(71) Applicant: POSCO, Pohang-si (KR)

(72) Inventors: Hang-Sik Cho, Gwangyang-si (KR); Jai-Hyun Kwak, Gwangyang-si (KR)

(73) Assignee: POSCO CO., LTD, Pohang-si (KR)

( * ) Notice: Subject to any disclaimer, the term of this patent is extended or adjusted under 35 U.S.C. 154(b) by 409 days.

This patent is subject to a terminal disclaimer.

(21) Appl. No.: 17/312,753

(22) PCT Filed: Dec. 19, 2019

(86) PCT No.: PCT/KR2019/018109
§ 371 (c)(1),
(2) Date: Jun. 10, 2021

(87) PCT Pub. No.: WO2020/130677
PCT Pub. Date: Jun. 25, 2020

(65) Prior Publication Data

US 2022/0056563 A1 Feb. 24, 2022

(30) Foreign Application Priority Data

Dec. 19, 2018 (KR) ..... 10-2018-0165146

(51) Int. Cl.

| | |
|---|---|
| ***C21D 9/46*** | (2006.01) |
| ***C21D 8/02*** | (2006.01) |
| ***C22C 38/02*** | (2006.01) |
| ***C22C 38/06*** | (2006.01) |
| ***C22C 38/22*** | (2006.01) |
| ***C22C 38/28*** | (2006.01) |
| ***C22C 38/32*** | (2006.01) |
| ***C22C 38/38*** | (2006.01) |
| ***C23C 2/06*** | (2006.01) |

(52) U.S. Cl.
CPC ..... *C22C 38/38* (2013.01); *C21D 8/0236* (2013.01); *C21D 9/46* (2013.01); *C22C 38/02* (2013.01); *C22C 38/06* (2013.01); *C22C 38/22* (2013.01); *C22C 38/28* (2013.01); *C22C 38/32* (2013.01); *C23C 2/06* (2013.01); *C21D 2211/001* (2013.01); *C21D 2211/005* (2013.01); *C21D 2211/008* (2013.01)

(58) Field of Classification Search
CPC ..... C21D 9/46
See application file for complete search history.

(56) References Cited

U.S. PATENT DOCUMENTS

| | | | | |
|---|---|---|---|---|
| 9,410,231 | B2 | 8/2016 | Okamoto et al. | |
| 9,809,874 | B2 * | 11/2017 | Tanaka | C21D 8/0473 |
| 2008/0000555 | A1 | 1/2008 | Nonaka et al. | |
| 2014/0170439 | A1 | 6/2014 | Allain et al. | |
| 2015/0059935 | A1 | 3/2015 | Hebesberger et al. | |
| 2016/0369369 | A1 * | 12/2016 | Takashima | C22C 38/16 |
| 2017/0101695 | A1 | 4/2017 | Arlazarov et al. | |
| 2019/0040482 | A1 | 2/2019 | Kimata et al. | |
| 2019/0185955 | A1 | 6/2019 | Yang et al. | |
| 2022/0042133 | A1 * | 2/2022 | Cho | C22C 38/34 |

FOREIGN PATENT DOCUMENTS

| | | |
|---|---|---|
| EP | 2837707 | 2/2015 |
| EP | 3164518 | 5/2017 |
| JP | 2006104532 | 4/2006 |
| JP | 2010275627 | 12/2010 |
| JP | 2013216946 | 10/2013 |
| JP | 2014019905 | 2/2014 |
| JP | 2016008310 | 1/2016 |
| JP | 2016191125 | 11/2016 |
| JP | 6354918 | 7/2018 |
| KR | 20140012167 | 1/2014 |
| KR | 101477877 | 12/2014 |
| KR | 20140143426 | 12/2014 |
| KR | 20160080818 | 7/2016 |
| KR | 101657842 | 9/2016 |
| KR | 20170002652 | 1/2017 |

(Continued)

OTHER PUBLICATIONS

International Search Report—PCT/KR2019/018109 dated Apr. 2, 2020.
European Search Report—European Application No. 19899805.6 issued on Oct. 12, 2021, citing EP 2837707, KR 10-1736634, and EP 3164518.
Japanese Office Action—Japanese Application No. 2021-534952 issued on Sep. 13, 2022, citing JP 2016-008310, KR 10-1736632, JP 2013-216946, JP 2016-191125, WO 2016/092733, and WO 2011/093490.

(Continued)

*Primary Examiner* — Jophy S. Koshy
(74) *Attorney, Agent, or Firm* — CANTOR COLBURN LLP

(57) ABSTRACT

A high strength cold rolled steel sheet having excellent burring properties includes: by weight %, 0.13-0.25% of carbon (C), 1.0-2.0% of silicon (Si), 1.5-3.0% of manganese (Mn), 0.08-1.5% of aluminum (Al)+chromium (Cr)+molybdenum (Mo), 0.1% or less of phosphorus (P), 0.01% or less of sulfur(S), 0.01% or less of nitrogen (N), and the balance of Fe and inevitable impurities; and, by area fraction, 3-25% of ferrite, 20-40% of martensite, 5-20% of residual austenite. The ferrite has an average grain size of 2 μm or less at the reference point of t/4 (wherein t refers to a steel sheet thickness), with the average ratio between lengths in the thickness direction and in the rolling direction being 1.5 or less.

20 Claims, 2 Drawing Sheets

(56) References Cited

FOREIGN PATENT DOCUMENTS

| | | |
|---|---|---|
| KR | 101736632 | 5/2017 |
| KR | 101736634 | 5/2017 |
| KR | 101877787 | 7/2018 |
| KR | 20180099867 | 9/2018 |
| WO | 2011093490 | 8/2011 |
| WO | 2015015239 | 2/2015 |
| WO | 2016092733 | 6/2016 |

OTHER PUBLICATIONS

Chinese Office Action—Chinese Application No. 201980081736.7 issued on May 23, 2022, citing KR 10-1736632 and JP 6354918.

* cited by examiner

HIGH-STRENGTH COLD ROLLED STEEL SHEET AND GALVANNEALED STEEL SHEET HAVING EXCELLENT BURRING PROPERTY, AND MANUFACTURING METHOD THEREFOR

TECHNICAL FIELD

The present disclosure relates to a cold-rolled steel sheet and a galvannealed steel sheet and a method of manufacturing the same, and more particularly, to a cold-rolled steel sheet and a galvannealed steel sheet having high strength characteristics and effectively-improved burring properties, and a method of manufacturing the same.

BACKGROUND ART

As automotive steel plates, the use of high-strength steels is increasingly increasing to secure the safety of vehicle occupants in accidents such as collisions and fuel economy regulations to preserve the global environment. The grade of automotive steel may usually be expressed as a product of tensile strength and elongation (TS×EL), and the method is not necessarily limited thereto. Advanced High Strength Steel (AHSS) in which TS×EL is less than 25,000 MPa·%, Ultra High Strength Steel (UHSS) in which TS×EL exceeds 50,000 MPa·%, and Extra-Advanced High Strength Steel (X-AHSS) having a value between AHSS and UHSS values, or the like, may be used as a representative example.

When the grade of the steel is determined, since the product of the tensile strength and the elongation is determined approximately constant, it may not be easy to satisfy the tensile strength and the elongation of the steel at the same time. This is because tensile strength and elongation are inversely proportional to each other, which is a characteristic of general steel.

As a steel material with a new concept to increase the product of the strength and elongation of steel, a steel material that uses the so-called Transformation Induced Plasticity (TRIP) phenomenon and may improve both workability and strength due to the presence of retained austenite in the steel material has been developed. Such TRIP steel has been mainly used to manufacture high-strength steel with high formability due to improved elongation even at the same strength.

However, such a related art steel material may be secured at a high level of tensile strength or elongation, but has a problem that it is vulnerable to burring.

Burring properties have been widely used as a property for evaluating the hole expansion workability of steel materials, but in recent years, the burring properties have not been necessarily limited to properties that evaluate the hole expansion workability of steel materials. For example, if burring properties are not sufficiently secured in a steel material subjected to extreme processing, it may be difficult to prevent the breakage of the steel material, and thus, burring properties may be used as an index that may confirm the breakage resistance of the steel material under extreme processing conditions. For example, in the case of a steel for automobiles processed under extreme conditions such as cold press working, not only high strength characteristics but also excellent burring properties are required to prevent damage to the steel due to processing.

PRIOR TECHNICAL LITERATURE (Patent Document 1) Japanese Unexamined Patent Application Publication No. 2014-019905 (published on Feb. 3, 2014)

DISCLOSURE

Technical Problem

An aspect of the present disclosure is to provide a high-strength cold-rolled steel sheet and a galvannealed steel sheet having excellent burring properties, and a method of manufacturing the same.

The subject of the present disclosure is not limited to the above description. Those of ordinary skill in the art will have no difficulty in understanding the additional subject of the present disclosure from the general contents of this specification.

Technical Solution

According to an aspect of the present disclosure, a high-strength cold rolled steel sheet having excellent burring properties includes, by weight %, 0.13-0.25% of carbon (C), 1.0-2.0% of silicon (Si), 1.5-3.0% of manganese (Mn), 0.08-1.5% of aluminum (Al)+chrome (Cr)+molybdenum (Mo), 0.1% or less of phosphorus (P), 0.01% or less of sulfur (S), 0.01% or less of nitrogen (N), and a balance of Fe, and unavoidable impurities; and by area fraction, 3-25% of ferrite, 20-40% of martensite, and 5-20% of retained austenite, wherein based on a 4/t point (where t is a steel sheet thickness), the ferrite has an average grain size of 2 μm or less, and an average value of a ratio of a ferrite length in a rolling direction of a steel sheet with respect to a length of the ferrite in a thickness direction of the steel sheet is 1.5 or less.

The cold-rolled steel sheet may further include 15 to 50% of bainite in an area fraction.

The martensite may be composed of tempered martensite and fresh martensite, and a proportion of the tempered martensite in the total martensite may exceed 50 area %.

The cold-rolled steel sheet may include ferrite of 3 to 15 area %.

The average value of a ratio of the ferrite length in the rolling direction of the steel sheet with respect to the length of the ferrite in the thickness direction of the steel sheet may be 0.5 or more.

The cold rolled steel sheet may further include, by weight %, at least one of boron (B): 0.001-0.005% and titanium (Ti): 0.005-0.04%.

The aluminum (Al) may be contained in the cold-rolled steel sheet in an amount of 0.01 to 0.09% by weight.

The chromium (Cr) may be contained in the cold-rolled steel sheet in an amount of 0.01 to 0.7% by weight.

The chromium (Cr) may be contained in the cold-rolled steel sheet in an amount of 0.2 to 0.6% by weight.

The molybdenum (Mo) may be contained in the cold-rolled steel sheet in an amount of 0.02 to 0.08% by weight.

The cold-rolled steel sheet may have a tensile strength of 1180 MPa or more, an elongation of 14% or more, and a hole expansion ratio (HER) of 25% or more.

The hole expansion ratio (HER) of the cold-rolled steel sheet may be 30% or more.

According to an aspect of the present disclosure, a high-strength galvannealed steel sheet having excellent burring properties includes a base steel plate and an alloyed hot-dip galvanized layer disposed on a surface of the base steel plate. The base steel plate may be the cold-rolled steel sheet.

According to an aspect of the present disclosure, a method of manufacturing a high-strength cold rolled steel sheet having excellent burring properties, includes cold rolling a steel material, and then, heating the steel material until the steel material is completely transformed into austenite, the steel material including, by weight %, carbon (C): 0.13 to 0.25%, silicon (Si): 1.0 to 2.0%, manganese (Mn): 1.5 to 3.0%, aluminum (Al)+chromium (Cr)+molybdenum (Mo): 0.08 to 1.5%, phosphorus (P): 0.1% or less, sulfur (S): 0.01% or less, nitrogen (N): 0.01% or less, and a balance of Fe and unavoidable impurities; slowly cooling the heated steel material at a cooling rate of 5 to 12° C./s to a slow cooling stop temperature of 630 to 670° C., and then maintaining the slow cooling stop temperature for 10 to 90 seconds; rapidly cooling the slow-cooled steel material at a cooling rate of 7 to 30° C./s to a temperature range of a martensitic transformation end temperature (Mf) or more and a martensitic transformation start temperature (Ms) or less; and partitioning treating by maintaining the rapidly-cooled steel material for 300 to 600 seconds at a temperature exceeding the martensitic transformation start temperature (Ms) and a bainite transformation start temperature (Bs) or less.

The steel material may further include, by weight %, at least one of boron (B): 0.001-0.005% and titanium (Ti): 0.005-0.04%.

The aluminum (Al) may be contained in the steel material in an amount of 0.01 to 0.09% by weight.

The chromium (Cr) may be contained in the steel material in an amount of 0.01 to 0.7% by weight.

The chromium (Cr) may be contained in the steel material in an amount of 0.2% to 0.6% by weight.

The molybdenum (Mo) may be contained in the steel material in an amount of 0.02 to 0.08% by weight.

According to an aspect of the present disclosure, a method of manufacturing a high-strength galvannealed steel sheet having excellent burring properties, includes forming a hot-dip galvanized layer on a surface of a base steel plate and performing alloy processing thereon, wherein the base steel plate is the cold-rolled steel sheet.

The means for solving the above problems are not all of the features of the present disclosure, and various features of the present disclosure and advantages and effects thereof will be understood in more detail with reference to the specific embodiments below.

Advantageous Effects

According to an exemplary embodiment, there are provided a cold-rolled steel sheet and a galvannealed steel sheet, particularly suitable as a steel sheet for automobiles due to excellent elongation characteristics and burring properties while having high strength characteristics, and a method of manufacturing the same.

BEST MODE FOR INVENTION

Figure 1:
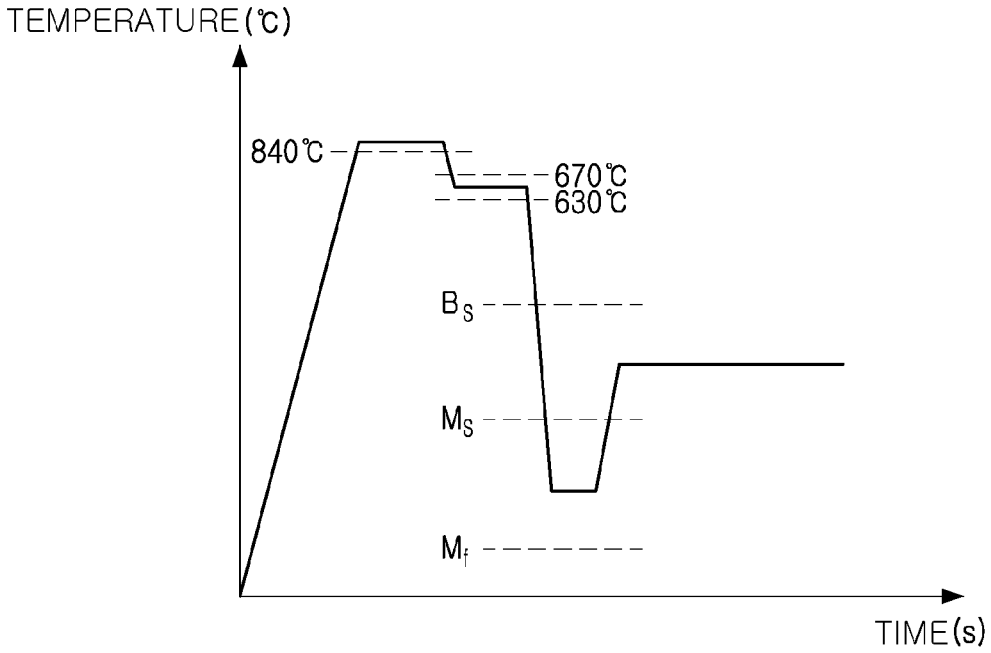
FIG. 1 is a graph schematically illustrating a manufacturing process using temperature change over time, according to an exemplary embodiment of the present disclosure.

The present disclosure relates to a cold-rolled steel sheet and a galvannealed steel sheet having excellent burring properties, and a method of manufacturing the same. Hereinafter, preferable embodiments of the present disclosure will be described. The embodiments of the present disclosure may be modified in various forms, and the scope of the present disclosure should not be construed as being limited to the embodiments described below. The embodiments are provided to further detail the present disclosure to those of ordinary skill in the art to which the present disclosure pertains.

Hereinafter, the steel composition of the present disclosure will be described in more detail. Hereinafter, unless otherwise indicated, the % indicating the content of each element is based on weight, unless otherwise indicated.

In an exemplary embodiment of the present disclosure, a cold-rolled steel sheet may include, by weight %, carbon (C): 0.13 to 0.25%, silicon (Si): 1.0 to 2.0%, manganese (Mn): 1.5 to 3.0%, aluminum (Al)+chromium (Cr)+molybdenum (Mo): 0.08 to 1.5%, phosphorus (P): 0.1% or less, sulfur (S): 0.01% or less, nitrogen (N): 0.01% or less, a balance of Fe and unavoidable impurities. In addition, the cold-rolled steel sheet according to an exemplary embodiment of the present disclosure may further include at least one of boron (B): 0.001 to 0.005% and titanium (Ti): 0.005 to 0.04% by weight %. The aluminum (Al), chromium (Cr), and molybdenum (Mo) may be included in an amount of 0.01 to 0.09%, 0.01 to 0.7%, and 0.02 to 0.08%, respectively, in weight %.

Carbon (C) 0.13-0.25%

Since carbon (C) is an important element that may secure strength economically, in the present disclosure, the lower limit of the carbon (C) content may be limited to 0.13% to obtain this effect. However, if carbon (C) is excessively added, a problem of deteriorating weldability may occur, and thus, in the present disclosure, the upper limit of the carbon (C) content may be limited to 0.25%. Therefore, the carbon (C) content of the present disclosure may range from 0.15 to 0.25%. A preferable carbon (C) content may range from 0.14 to 0.25%, and a more preferable carbon (C) content may range from 0.14 to 0.20%.

Silicon (Si): 1.0-2.0%

Since silicon (Si) is an element capable of effectively improving the strength and elongation of a steel material, in the present disclosure, the lower limit of the silicon (Si) content may be limited to 1.0% to obtain this effect. Since silicon (Si) not only causes surface scale defects, but also degrades the surface properties of the plated steel sheet and deteriorates chemical conversion treatment properties, the content of silicon (Si) was usually limited to 1.0% or less, but due to the recent development of plating technology or the like, the steel with the content of up to about 2.0% of silicon has been manufactured without any major problems. Therefore, in the present disclosure, the upper limit of the silicon (Si) content may be limited to 2.0%. Thus, the silicon (Si) content of the present disclosure may be in the range of 1.0 to 2.0%. A preferable silicon (Si) content may range from 1.2 to 2.0%, and a more preferable silicon (Si) content may range from 1.2 to 1.8%.

Manganese (Mn): 1.5-3.0%

Manganese (Mn) is an element that may serve to further increase solid solution strengthening when it is present in steel, and is an element that contributes to the improvement of hardenability in transformation strengthened steel. Therefore, in the present disclosure, the lower limit of manganese (Mn) content may be limited to 1.5%. However, if manganese (Mn) is excessively added, problems such as weldability and cold rolling load are likely to occur, and surface defects such as dents may be caused by the formation of annealing concentrate. Thus, the upper limit of the Mn content may be limited to 3.0%. Therefore, the manganese (Mn) content of the present disclosure may be in the range of 1.5 to 3.0%. A preferable manganese (Mn) content may be in the range of 2.0 to 3.0%, and a more preferable manganese (Mn) content may be in the range of 2.2 to 2.9%.

Sum of Aluminum (Al), Chromium (Cr) and Molybdenum (Mo): 0.08 to 1.5%

Since aluminum (Al), chromium (Cr) and molybdenum (Mo) are useful elements to increase the strength and secure the ferrite fraction as a ferrite-region expansion element, in the present disclosure, the sum of aluminum (Al), chromium (Cr) and molybdenum (Mo) contents may be limited to 0.08% or more. However, if aluminum (Al), chromium (Cr) and molybdenum (Mo) are excessively added, the surface quality of the slab decreases and the increase in manufacturing cost may be problematic, and thus, in the present disclosure, the sum of aluminum (Al), chromium (Cr) and molybdenum (Mo) contents may be limited to 1.5% or less. Accordingly, the sum of the contents of aluminum (Al), chromium (Cr) and molybdenum (Mo) in the present disclosure may range from 0.08 to 1.5%.

Aluminum (Al): 0.01-0.09%

Aluminum (Al) is an important element in improving martensite hardenability by bonding with oxygen (O) in steel and acting as a deoxidation, and partitioning carbon (C) in ferrite into austenite, together with silicon (Si). To obtain such an effect, in the present disclosure, the lower limit of the aluminum (Al) content may be limited to 0.01%. However, if aluminum (Al) is excessively added, there is a possibility that nozzle clogging may occur during continuous casting, and a decrease in burring properties due to an increase in strength may be problematic. Thus, in the present disclosure, the upper limit of the aluminum (Al) content may be limited to 0.09%. Therefore, the aluminum (Al) content of the present disclosure may be in the range of 0.01 to 0.09%. A preferable aluminum (Al) content may range from 0.02 to 0.09%, and a more preferable aluminum (Al) content may range from 0.02 to 0.08%. In the present disclosure, aluminum (Al) refers to acid-soluble Al (sol·Al).

Chrome (Cr): 0.01-0.7%

Since chromium (Cr) is an effective hardenability enhancing element, in the present disclosure, the lower limit of the chromium (Cr) content may be limited to 0.01% to obtain the effect of improving strength. However, if chromium (Cr) is excessively added, the oxidation of silicon (Si) is promoted to increase red-scale defects on the surface of the hot-rolled material and cause a decrease in the surface quality of the final steel. Thus, in the present disclosure, the upper limit of the chromium (Cr) content may be limited to 0.7%. Therefore, the chromium (Cr) content of the present disclosure may be in the range of 0.2 to 0.7%. A preferable chromium (Cr) content may range from 0.1 to 0.7%, and a more preferable chromium (Cr) content may range from 0.2 to 0.6%.

Molybdenum (Mo): 0.02-0.08%

Since molybdenum (Mo) is also an element that effectively contributes to the improvement of hardenability, in the present disclosure, the lower limit of the molybdenum (Mo) content may be limited to 0.02% to obtain the effect of improving strength. However, molybdenum (Mo) is an expensive element, and excessive addition is not preferable in terms of economic efficiency, and if molybdenum (Mo) is excessively added, the strength is excessively increased, resulting in a problem that the burring properties are deteriorated. Therefore, the upper limit of the molybdenum (Mo) content may be limited to 0.08% in the present disclosure. A preferable molybdenum (Mo) content may range from 0.03 to 0.08%, and a more preferable molybdenum (Mo) content may range from 0.03 to 0.07%.

Phosphorus (P): 0.1% or Less

Phosphorus (P) is an element that is advantageous for securing strength without deteriorating the formability of steel, but if excessively added, the possibility of brittle fracture is greatly increased, increasing the possibility of plate fracture of the slab during hot rolling, and thus, P may also act as an element that impairs plating surface properties. Accordingly, in the present disclosure, the upper limit of the phosphorus (P) content may be limited to 0.1%, and a more preferable upper limit of the phosphorus (P) content may be 0.05%. However, 0% may be excluded in consideration of the inevitably added level.

Sulfur (S): 0.01% or Less

Since sulfur (S) is an element that is inevitably added as an impurity element in steel, it may be desirable to manage the content thereof as low as possible. In detail, sulfur (S) is an element that inhibits the ductility and weldability of steel, and in the present disclosure, it may be preferable to suppress the content as much as possible. Accordingly, in the present disclosure, the upper limit of the sulfur (S) content may be limited to 0.01%, and a more preferable upper limit of the sulfur (S) content may be 0.005%. However, 0% may be excluded in consideration of the inevitably added level.

Nitrogen (N): 0.01% or Less

Nitrogen (N) is an element that is inevitably added as an impurity element. It may be important to manage nitrogen (N) as low as possible, but to this end, there is a problem that the refining cost of steel increases rapidly. Accordingly, in the present disclosure, the upper limit of the nitrogen (N) content may be controlled to be 0.01% in consideration of the possible range under the operating conditions, and a more preferable upper limit of the nitrogen (N) content may be 0.005%. However, 0% may be excluded in consideration of the inevitably added level.

Boron (B): 0.001-0.005%

Boron (B) is an element that effectively contributes to the improvement of strength due to solid solution, and is an effective element capable of securing such an effect even when added in a small amount. Therefore, in the present disclosure, the lower limit of the boron (B) content may be limited to 0.001% to obtain such an effect. However, when boron (B) is added excessively, the strength enhancing effect is saturated, whereas an excessive boron (B) thickening layer may be formed on the steel surface to cause deterioration of plating adhesion. Therefore, in the present disclosure, the upper limit of boron (B) content may be limited to 0.005%. Therefore, the boron (B) content of the present disclosure may range from 0.001 to 0.005%. A preferable boron (B) content may range from 0.001 to 0.004%, and a more preferable boron content may range from 0.0013 to 0.0035%.

Titanium (Ti): 0.005-0.04%

Titanium (Ti) is an element that is effective in increasing the strength of steel and miniaturizing the particle size. In addition, titanium (Ti) is combined with nitrogen (N) to form TiN precipitates, and thus, is an element that may effectively prevent boron (B) from being combined with nitrogen (N) and the addition effect of boron (B) from disappearing. Accordingly, in the present disclosure, the lower limit of the titanium (Ti) content may be limited to 0.005%. However, if titanium (Ti) is excessively added, it may cause nozzle clogging during continuous casting, or the ductility of the steel may be deteriorated due to excessive generation of precipitates. Thus, in the present disclosure, the upper limit of the titanium (Ti) content may be limited to 0.04%. Therefore, the titanium (Ti) content of the present disclosure may range from 0.005 to 0.04%. A preferable titanium (Ti) content may range from 0.01 to 0.04%, and a more preferable titanium (Ti) content may range from 0.01 to 0.03%.

Other than the above-described steel composition, the cold-rolled steel sheet according to an exemplary embodiment of the present disclosure may contain Fe and unavoidable impurities as the balance thereof. The unavoidable impurities may be unintentionally incorporated in a general steel manufacturing process and cannot be completely excluded, and a person skilled in the ordinary steel manufacturing field may easily understand the meaning. In addition, the present disclosure does not entirely exclude the addition of a composition other than the above-mentioned steel composition.

Hereinafter, the microstructure of a steel according to an exemplary embodiment of the present disclosure will be described in more detail. Hereinafter, unless specifically indicated otherwise, % representing the proportion of microstructure is based on the area.

The inventors of the present disclosure examined conditions for simultaneously securing the strength and elongation of the steel sheet and also having burring properties, and as a result, even when the strength and elongation were controlled within an appropriate range by appropriately controlling the composition and type and fraction of the structure of the steel material, it was confirmed that high burring properties could not be obtained unless the shape of the structure existing in the steel material was properly controlled, and the inventors have come to the present disclosure.

To secure the strength and elongation of the steel material in the present disclosure, the composition of ferrite in the steel material may be controlled to be within an appropriate range, and in addition, a TRIP steel containing retained austenite and martensite is targeted.

In general, in the TRIP steel, martensite is included in a predetermined range in the steel to secure high strength, and ferrite is included in a predetermined range to secure the elongation of the steel. The retained austenite is transformed into martensite during the processing process, and through this transformation process, the workability of the steel material may be improved.

In this respect, the ferrite of the present disclosure may be included in a ratio of 3 to 25 area %. For example, to provide sufficient elongation, it is necessary to control the ferrite ratio to be 3 area % or more, and to prevent the strength from deteriorating due to excessive formation of ferrite, which is a soft structure, the ratio of ferrite may be controlled to be 25 area % or less. A preferable ferrite fraction may be 20 area % or less, and a more preferable ferrite fraction may be 15 area % or less, or less than 15 area %.

In addition, to secure sufficient strength, martensite may be preferably included in a ratio of 20 area % or more, and since the elongation may decrease due to excessive formation of martensite, which is a hard structure, the ratio of martensite may be controlled to be 40 area % or less.

The martensite of the present disclosure is composed of tempered martensite and fresh martensite, and the ratio of the tempered martensite in the total martensite may exceed 50 area %. A preferable ratio of tempered martensite may be 60 area % or more relative to the total martensite. Fresh martensite is effective for securing strength, but tempered martensite may be more preferable in terms of both strength and elongation.

In addition, when the retained austenite is included, the TS×EL of the steel is increased, and thus, the balance between strength and elongation as a whole may be improved. Therefore, it may be preferable that retained austenite is contained in an amount of 5 area % or more. However, if the retained austenite is excessively formed, there is a problem that the sensitivity of hydrogen embrittlement may increase, and therefore, the fraction of retained austenite may be preferably controlled to 20 area % or less.

Separately, in the present disclosure, 15 to 50 area % of bainite may be further included as an area fraction. Since bainite may improve the burring properties by reducing the strength difference between the structures, it may be preferable to control the bainite fraction to 15 area % or more. However, if the bainite is excessively formed, the burring properties may be lowered. Therefore, the fraction of bainite may be preferably controlled to 50 area % or less.

Since the steel according to an exemplary embodiment of the present disclosure includes martensite, which is a hard structure, and ferrite, which is a soft structure, during burring or similar press processing, cracks may be initiated and propagated at the boundary between the soft structure and the hard structure. The ferrite structure may greatly contribute to the improvement of the elongation, but has a disadvantage of promoting the occurrence of cracks due to the difference in hardness between the ferrite and martensite structures in the burring process or the like.

To prevent such a form of damage, in an example of the present disclosure, the ferrite may be refined and the length ratio (length of the steel sheet in the rolling direction/length of the steel sheet in the thickness direction) may also be limited to a predetermined range. The inventors of the present disclosure studied in depth the shape of ferrite existing in TRIP steel and the crack generation and propagation characteristics during processing, and it was confirmed that the length ratio of ferrite (length of the steel sheet in the rolling direction of the steel sheet/length of the steel sheet in the thickness direction) as well as the grain size of the ferrite affects the generation of cracks and propagation characteristics during processing.

For example, since ferrite, which is a soft structure in a general TRIP steel, is present in a form elongated in the rolling direction, cracks generated during processing even due to refining of ferrite grains may be effectively suppressed from easily proceeding in the rolling direction. Accordingly, in the present disclosure, while miniaturizing the ferrite present in the final steel material, the generation and propagation of cracks may also be significantly reduced by controlling the shape of the ferrite.

In an exemplary embodiment of the present disclosure, ferrite may be refined by controlling the average grain size of ferrite to 2 μm or less, and the average ferrite length ratio (length of the steel sheet in the rolling direction of the steel sheet/length of the steel sheet in the thickness direction) may also be controlled to be 1.5 or less. For example, in the present disclosure, the grains of ferrite are refined to a certain level or less, and in detail, the average ferrite grain length ratio (length of the steel sheet in the rolling direction of the steel sheet/length of the steel sheet in the thickness direction) is controlled to be a certain level or less. Therefore, by effectively preventing the occurrence and progress of cracks, burring properties of the steel material may be effectively secured. However, since there is a limit on the process in controlling the average ferrite length ratio (length of the steel sheet in the rolling direction of the steel sheet/length of the steel sheet in the thickness direction) to be less than a certain level, in the present disclosure, the lower limit of the average ferrite length ratio (length of the steel sheet in the rolling direction of the steel sheet/length of the steel sheet in the thickness direction) may be limited to 0.5.

The ratio of the average ferrite grain size and the average ferrite length according to an exemplary embodiment of the present disclosure is based on a point of t/4, where t is the thickness (mm) of the steel sheet.

In the present disclosure, since the ferrite is refined and the length ratio of ferrite is also controlled to an optimum level, generation and progression of cracks during processing of a steel material may be effectively suppressed, and accordingly, damage of the steel material may be effectively prevented.

In addition, according to an exemplary embodiment of the present disclosure, a hot-dip galvanized steel sheet in which a hot-dip galvanized layer is formed on the above-described cold-rolled steel sheet may be included, and a galvannealed steel sheet obtained by alloying the same may be provided. The hot-dip galvanized layer may be provided in a composition commonly used to secure corrosion resistance, and may include additional elements such as aluminum (Al), magnesium (Mg) and the like in addition to zinc (Zn).

The cold-rolled steel sheet and the galvannealed steel sheet of the present disclosure satisfying these conditions may satisfy tensile strength of 1180 MPa or more, elongation of 14% or more, and Hole Expansion Ratio (HER) of 25% or more. In terms of securing burring properties, a more preferable hole expansion device (HER) may be 30% or more.

Hereinafter, a manufacturing method according to an exemplary embodiment will be described in more detail.

After cold-rolling the steel having the above composition, the cold-rolled steel is heated such that the steel is completely transformed into austenite, and the heated steel is slowly cooled to a slow cooling stop temperature of 630 to 670° C. at a cooling rate of 5 to 12° C./s, and is then maintained at the slow cooling stop temperature for 30 to 90 seconds. The slow cooled and maintained steel is rapidly cooled to a temperature ranging from the martensitic transformation end temperature (Mf) or more to the martensitic transformation start temperature (Ms) or less, at a cooling rate of 7 to 30° C./s. The rapidly-cooled steel may be maintained at a temperature that is greater than the martensitic transformation start temperature (Ms) and is the bainite transformation start temperature (Bs) or less, for 300 to 600 seconds, and may then be partitioning treated. The process conditions of the present disclosure after cold rolling are illustrated in FIG. 1 by using the temperature change with time.

The steel provided for the cold rolling of the present disclosure may be a hot-rolled material, and such a hot-rolled material may be a hot-rolled material used in general TRIP steel manufacturing. A method of manufacturing a hot-rolled material provided for the cold rolling of the present disclosure is not particularly limited, but a slab provided with the above composition is reheated at a temperature ranging from 1000 to 1300° C., and is hot rolled in a finish rolling temperature range of 800 to 950° C., thereby producing the hot-rolled material by being wound at a temperature range of 750° C. or less. Cold rolling of the present disclosure may also be carried out under the process conditions carried out in the production of general TRIP steel. Cold rolling may be performed at an appropriate reduction ratio to secure the thickness required by the customer, but it may be preferable to perform cold rolling at a cold reduction ratio of 30% or more to suppress the generation of coarse ferrite in the subsequent annealing process.

Hereinafter, the process conditions according to an exemplary embodiment will be described in more detail.

After Cold Rolling, Steel being Heated in the Austenite Area

To transform the entire structure of the cold-rolled steel into austenite, the steel is heated to an austenite temperature region (full austenite region). Usually, in the case of a TRIP steel containing ferrite at a certain level, the steel is often heated in the so-called two-phases region temperature range in which austenite and ferrite coexist, but when heated in this manner, it may be significantly difficult to obtain ferrite having the particle size and partitioning intended in the present disclosure. Furthermore, the band structure generated in the hot rolling process remains as it is, which is disadvantageous in improving burring properties. Therefore, in the present disclosure, the cold-rolled steel may be heated to an austenite region of 840° C. or higher.

Slow Cooling and Maintenance of Heated Steel to a Range of 630 to 670° C.

In the present disclosure, to refine the ferrite and adjust the length ratio, the heated steel may be slowly cooled at a cooling rate of 5 to 12° C./s and then maintained in the corresponding temperature range for a certain period of time. This is because ferrite having fine grains may be formed inside the steel by the multiple nucleation action during the slow cooling of the heated steel. Accordingly, in the present disclosure, to increase the nucleation site of ferrite and control the length ratio of ferrite, the heated steel may be slowly cooled to a predetermined temperature range. If slow cooling is stopped by exceeding the slow cooling stop temperature and rapid cooling is performed immediately, sufficient ferrite fraction cannot be secured, which is disadvantageous in terms of securing the elongation. If slow cooling is performed to a temperature less than the slow cooling stop temperature, since the ratio of structures other than ferrite is not sufficient and it is disadvantageous in terms of securing strength, in the present disclosure, the slow cooling stop temperature may be limited to a range of 630 to 670° C. In addition, since as the slow cooling of the present disclosure, a slightly faster cooling rate compared to general slow cooling conditions is applied, and thus, the nucleation site of ferrite may be effectively increased. Therefore, the cooling rate in the slow cooling of the present disclosure may be in the range of 5 to 12° C./s, but a more preferable cooling rate in terms of increasing ferrite nucleation sites may be in the range of 7 to 12° C./s.

After cooling the steel to a temperature range of 630 to 670° C., the slow-cooled steel in the temperature range may be maintained for 10 to 90 seconds. In the present disclosure, since the heated steel is slowly cooled and then maintained, ferrite generated by slow cooling may be effectively prevented from being coarsened. For example, since in the present disclosure, ferrite may be effectively prevented from growing in the rolling direction by slow cooling and holding, the length ratio (length of the steel sheet in the rolling direction of the steel sheet/length of the steel sheet in the thickness direction) of the ferrite may be effectively controlled.

Rapid Cooling of Slow-Cooled and Maintained Steel to a Temperature of Mf-Ms

To obtain the martensite of the ratio intended in the present disclosure, a procedure of rapidly cooling the slowly cooled and maintained steel to a temperature ranging from Mf to Ms may be followed. In this case, Mf denotes the martensite transformation end temperature, and Ms denotes the martensite transformation start temperature. Since the slow cooled and maintained steel is rapidly cooled to a temperature ranging from Mf to Ms, martensite and retained austenite may be introduced into the steel after the rapid cooling. In detail, since the rapid cooling stop temperature is controlled to be Ms or less, martensite may be introduced into the steel after rapid cooling, and since the rapid cooling stop temperature is controlled to be Mf or more, all austenite may be prevented from being transformed into martensite, and thus, retained austenite may be introduced into the steel after rapid cooling. During rapid cooling, a preferable cooling rate may be in the range of 7 to 30° C./s, and one preferable means may be quenching.

Partitioning Treatment of Quenched Steel

In the quenched structure, martensite is diffusionless transformation of austenite containing a large amount of carbon, and thus, a large amount of carbon is contained in martensite. In this case, the hardness of the structure may be high, but on the contrary, there may be a problem that the toughness is rapidly deteriorated. In general, a method of tempering a steel at a high temperature such that carbon precipitates as carbide in martensite is used. However, in the present disclosure, a method other than tempering may be used to control the structure with a unique method.

For example, in the present disclosure, by maintaining the quenched steel in a temperature range of more than Ms and Bs or less for a predetermined period of time, carbon existing in martensite is partitioned into retained austenite due to the difference in solid solution, and a predetermined amount of bainite is induced to be created. In this case, Ms denotes the martensite transformation start temperature, and Bs denotes the bainite transformation start temperature. When the carbon solid solution of retained austenite increases, the stability of retained austenite increases, and thus the retained austenite fraction required in the present disclosure may be effectively secured.

In addition, by maintaining the steel as described above, the steel of the present disclosure may contain bainite in an area ratio of 15 to 50%. For example, in the present disclosure, carbon is partitioned between martensite and retained austenite in the first cooling operation and the second holding operation after quenching, and a portion of martensite is transformed into bainite, thereby obtaining the structural configuration required in an exemplary embodiment of the present disclosure.

To obtain a sufficient partitioning effect, the above-described holding time may be 300 seconds or more. However, if the holding time exceeds 600 seconds, it is not only difficult to expect an increase in the effect any more, but also productivity may be lowered. Accordingly, in an exemplary embodiment of the present disclosure, the upper limit of the above-described holding time may be limited to 600 seconds.

The cold-rolled steel sheet subjected to the above-described treatment may then be hot-dip galvanized by a known method. In addition, the hot-dip galvanized steel sheet may be alloyed by a known method.

The cold-rolled steel sheet manufactured by the above manufacturing method includes, by area fraction, ferrite: 3 to 25%, martensite: 20 to 40%, and retained austenite: 5 to 20%, wherein based on a 4/t point (where t is a steel sheet thickness), the ferrite has an average grain size of 2 μm or less, and an average value of a ratio of a ferrite length in a rolling direction of a steel sheet with respect to a length of the ferrite in a thickness direction of the steel sheet may be 1.5 or less.

In addition, the cold-rolled steel sheet and the galvannealed steel sheet manufactured by the above manufacturing method may satisfy a tensile strength of 1180 MPa or more, an elongation of 14% or more, and a hole expansion ratio (HER) of 25% or more.

MODE FOR INVENTION

Hereinafter, the present disclosure will be described in more detail through examples. However, it should be noted that the following examples are only for exemplifying the present disclosure and not for limiting the scope of the present disclosure.

Example

A cold rolled steel sheet was manufactured by treating the steel material of the composition illustrated in Table 1 below under the conditions illustrated in Table 2. In Table 2, rapid cooling was performed by spraying a mist onto the surface of the cold-rolled steel sheet or by spraying nitrogen gas or nitrogen-hydrogen mixed gas thereonto. Comparative Example 1 is a case in which the partitioning treatment was performed for a period of time shorter than the partitioning period of time of the present disclosure, and Comparative Examples 2 and 4 are cases in which heating was performed in a temperature range lower than the heating temperature of the present disclosure. Comparative Example 5 is a case in which slow cooling was performed at a cooling rate slower than the slow cooling rate of the present invention and the slow cooling was terminated in a temperature range lower than the slow cooling stop temperature range of the present disclosure, and rapid cooling was performed immediately without maintaining after the slow cooling. The holding temperature after the rapid cooling satisfies the relationship of more than Ms and less than Bs in all inventive examples and comparative examples.

TABLE 1

| Classification | Steel Composition (wt %) | | | | | | | | | | |
|---|---|---|---|---|---|---|---|---|---|---|---|
| | C | Si | Mn | P | S | Al | N | Cr | Mo | Ti | B |
| Inventive Example 1 | 0.24 | 1.5 | 2.4 | 0.007 | 0.002 | 0.034 | 0.004 | 0.4 | 0 | 0.02 | 0.002 |
| Inventive Example 2 | 0.18 | 1.3 | 2.7 | 0.013 | 0.004 | 0.055 | 0.006 | 0.5 | 0 | 0.02 | 0.002 |
| Inventive Example 3 | 0.2 | 1.4 | 2.5 | 0.01 | 0.006 | 0.062 | 0.005 | 0.12 | 0.01 | 0.02 | 0.002 |
| Inventive Example 4 | 0.19 | 1.6 | 2.4 | 0.015 | 0.005 | 0.04 | 0.006 | 0.2 | 0.05 | 0.02 | 0.002 |
| Inventive Example 5 | 0.2 | 1.7 | 2.6 | 0.006 | 0.005 | 0.21 | 0.004 | 0.01 | 0.03 | 0.02 | 0.002 |
| Inventive Example 6 | 0.16 | 1.1 | 2.8 | 0.011 | 0.006 | 0.047 | 0.005 | 0.03 | 0.02 | 0.02 | 0.002 |
| Comparative Example 1 | 0.22 | 1.2 | 2.5 | 0.008 | 0.005 | 0.39 | 0.006 | 0.05 | 0.05 | 0.02 | 0.002 |
| Comparative Example 2 | 0.15 | 2.3 | 1.2 | 0.013 | 0.01 | 0.05 | 0.004 | 0.001 | 0.05 | 0.02 | 0.002 |
| Comparative Example 3 | 0.27 | 10.1 | 1.1 | 0.015 | 0.008 | 0.043 | 0.005 | 0.002 | 0.01 | 0.02 | 0.002 |
| Comparative Example 4 | 0.16 | 1.4 | 2.2 | 0.01 | 0.005 | 0.03 | 0.006 | 0.008 | 0 | 0.02 | 0.002 |
| Comparative Example 5 | 0.2 | 1.7 | 2.6 | 0.006 | 0.005 | 0.21 | 0.004 | 0.01 | 0.03 | 0.02 | 0.002 |

TABLE 2

| Classification | Heating Temperature (° C.) | Heating time (seconds) | Slow cooling stop temperature (° C.) | Slow cooling rate (° C./s) | Holding time after slow cooling (seconds) | Rapid cooling stop temperature (° C.) | Holding temperature after rapid cooling (° C.) | Holding time after rapid cooling (seconds) | Plated Not plated |
|---|---|---|---|---|---|---|---|---|---|
| Inventive Example 1 | 860 | 60 | 650 | 25 | 60 | 300 | 400 | 500 | Not performed |
| Inventive Example 2 | 870 | 60 | 650 | 25 | 60 | 300 | 400 | 500 | Not performed |
| Inventive Example 3 | 860 | 60 | 650 | 25 | 60 | 300 | 400 | 500 | Performed |
| Inventive Example 4 | 870 | 60 | 650 | 25 | 60 | 300 | 400 | 500 | Performed |
| Inventive Example 5 | 870 | 60 | 650 | 25 | 60 | 300 | 400 | 500 | Performed |
| Inventive Example 6 | 850 | 60 | 650 | 25 | 60 | 300 | 400 | 500 | Performed |

TABLE 2-continued

| Classification | Heating Temperature (° C.) | Heating time (seconds) | Slow cooling stop temperature (° C.) | Slow cooling rate (° C./s) | Holding time after slow cooling (seconds) | Rapid cooling stop temperature (° C.) | Holding temperature after rapid cooling (° C.) | Holding time after rapid cooling (seconds) | Plated Not plated |
|---|---|---|---|---|---|---|---|---|---|
| Comparative Example 1 | 870 | 60 | 650 | 25 | 60 | 300 | 400 | 100 | Performed |
| Comparative Example 2 | 830 | 60 | 650 | 25 | 60 | 300 | 400 | 500 | Performed |
| Comparative Example 3 | 870 | 60 | 650 | 25 | 60 | 300 | 400 | 500 | Not performed |
| Comparative Example 4 | 810 | 60 | 650 | 25 | 60 | 300 | 400 | 500 | Performed |
| Comparative Example 5 | 870 | 60 | 600 | 3.5 | 0 | 300 | 400 | 500 | Performed |

The results of evaluation of the internal structure and physical properties of the cold-rolled steel sheet manufactured by the above-described process are illustrated in Table 3 below. The microstructure of each cold-rolled steel sheet was observed and evaluated using a scanning electron microscope, and a tensile test piece of JIS No. 5 was produced to measure and evaluate yield strength (YS), tensile strength (TS), elongation (T-El), and hole expansion ratio (HER). Plating evaluation was performed only on the plated steel, and was determined based on whether there was an unplated area on the surface (X) or not (O).

TABLE 3

| Classification | Ferrite average grain size (μm) | Ferrite length ratio (rolling direction/thickness direction) | Ferrite fraction (area %) | Martensite fraction (area %) | Fraction of retained austenite (area %) | Bainite fraction (area %) | Yield strength (MPa) | Tensile strength (MPa) | Elongation (%) | HER (%) | Plating |
|---|---|---|---|---|---|---|---|---|---|---|---|
| Inventive Example 1 | 1.1 | 0.98 | 14 | 27 | 15 | 44 | 783 | 1195 | 18 | 32 | — |
| Inventive Example 2 | 1 | 1.06 | 11 | 32 | 12 | 45 | 984 | 1210 | 18 | 40 | — |
| Inventive Example 3 | 0.9 | 1.2 | 21 | 30 | 13 | 36 | 910 | 1249 | 17 | 28 | ○ |
| Inventive Example 4 | 1 | 1.26 | 20 | 29 | 12 | 39 | 898 | 1235 | 16 | 27 | ○ |
| Inventive Example 5 | 0.8 | 1.1 | 8 | 34 | 11 | 47 | 1021 | 1278 | 16 | 38 | ○ |
| Inventive Example 6 | 0.9 | 1.12 | 9 | 30 | 12 | 49 | 968 | 1202 | 15 | 35 | ○ |

TABLE 3-continued

| Classification | Ferrite average grain size (μm) | Ferrite length ratio (rolling direction/thickness direction) | Ferrite fraction (area %) | Martensite fraction (area %) | Fraction of retained austenite (area %) | Bainite fraction (area %) | Yield strength (MPa) | Tensile strength (MPa) | Elongation (%) | HER (%) | Plating |
|---|---|---|---|---|---|---|---|---|---|---|---|
| Comparative Example 1 | 0.9 | 0.99 | 10 | 41 | 4 | 45 | 873 | 1351 | 9 | 17 | ○ |
| Comparative Example 2 | 3.4 | 1.6 | 12 | 20 | 20 | 48 | 763 | 1100 | 15 | 23 | X |
| Comparative Example 3 | 0.8 | 1.1 | 5 | 55 | 3 | 37 | 1120 | 1398 | 8 | 31 | — |
| Comparative Example 4 | 4.4 | 1.8 | 16 | 25 | 10 | 49 | 628 | 1153 | 17 | 11 | ○ |
| Comparative Example 5 | 2.2 | 1.1 | 8 | 30 | 12 | 50 | 958 | 1242 | 16 | 24 | ○ |

As can be seen in Table 3, in Inventive Examples 1 to 6 satisfying the composition of the present disclosure and satisfying the manufacturing conditions of the present disclosure, an average grain size of ferrite is 2 μm or less, and the ratio of the length of the ferrite in the rolling direction of the ferrite to the length of the ferrite in the thickness direction is 1.5 or less on average. Therefore, it can be seen that the yield strength and tensile strength are high, and high elongation and hole expansion ratio (HER) are also exhibited.

Meanwhile, it can be seen that in Comparative Examples 1 to 5, which do not satisfy the steel composition of the present disclosure and/or the manufacturing conditions of the present disclosure, the elongation and/or hole expansion ratio (HER) required by the present disclosure are not secured.

In Comparative Example 1, it can be confirmed that the retained austenite was not sufficiently formed by performing a partitioning treatment time shorter than the partitioning time limited by the present disclosure, and thus the elongation was poor.

In Comparative Examples 2 and 4, it can be seen that coarse ferrite was formed by heating in a temperature range lower than the heating temperature limited by the present disclosure, and the hole expansion ratio (HER) was inferior, and the plating property was inferior.

In Comparative Example 3, since the C content exceeded the range of the present disclosure, and Si and Mn did not reach the range of the present disclosure, it was confirmed that ferrite was not sufficiently formed and thus the elongation was poor.

In Comparative Example 5, since the slow cooling condition after heating was out of the scope of the present disclosure, it can be seen that ferrite was formed coarse and the required hole expansion ratio (HER) could not be secured.

Figure 2:
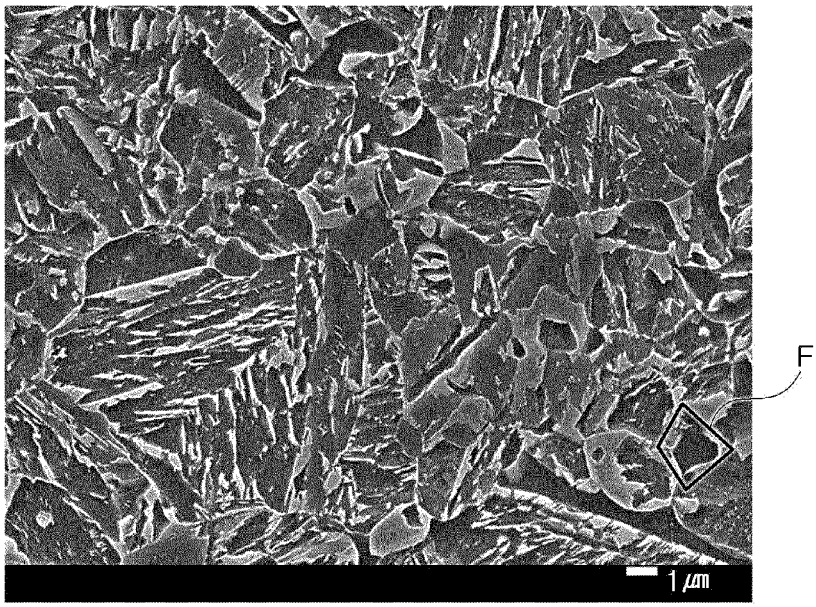
FIG. 2 is an image obtained by observing a microstructure of Inventive Example 1 with a scanning electron microscope.
Figure 3:
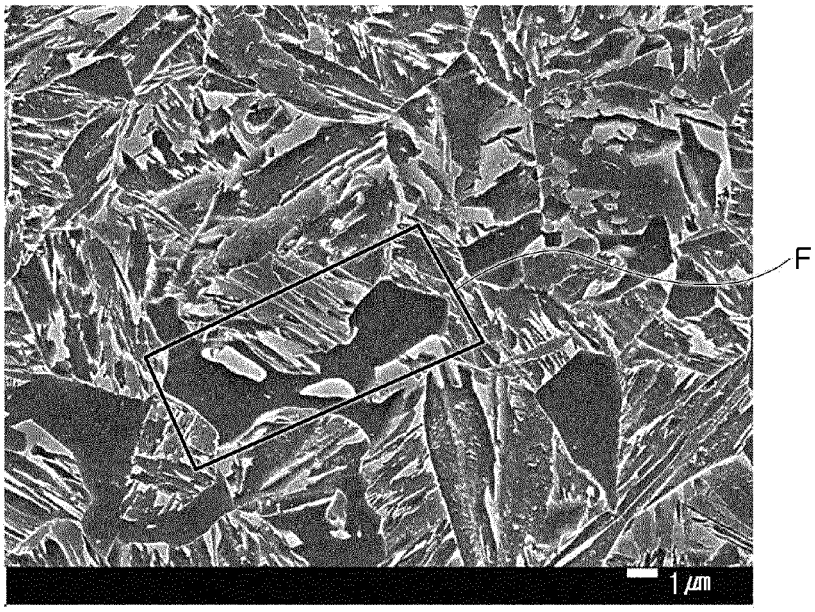
FIG. 3 is an image obtained by observing a microstructure of Comparative Example 2 with a scanning electron microscope.

FIG. 2 is an image of observing the microstructure of Inventive Example 1 with a scanning electron microscope, and FIG. 3 is an image of observing the microstructure of Comparative Example 2 with a scanning electron microscope. As illustrated in FIGS. 2 and 3, it can be seen that the ferrite (F) of Inventive Example 1 is formed finely, whereas the ferrite (F) of Comparative Example 2 is coarse and is present in a shape elongated in the rolling direction.

Therefore, according to an exemplary embodiment of the present disclosure, it can be confirmed that a cold rolled steel sheet, in detail, suitable as a material for a vehicle may be provided with a tensile strength of 980 MPa or more, an elongation of 14%, and a Hole Expansion Ratio (HER) of 25% or more.

Although the present disclosure has been described in detail through examples above, other types of examples are also possible. Therefore, the technical spirit and scope of the claims set forth below are not limited by the embodiments.

The invention claimed is:

1. A cold rolled steel sheet comprising:

by weight %, 0.13-0.25% of carbon (C), 1.0-2.0% of silicon (Si), 1.5-3.0% of manganese (Mn), 0.08-1.5% of aluminum (Al)+chromium (Cr)+molybdenum (Mo), 0.1% or less of phosphorus (P), 0.01% or less of sulfur(S), 0.01% or less of nitrogen (N), and a balance of Fe, and unavoidable impurities; and by area fraction, 8-25% of ferrite, 20-40% of martensite, and 5-20% of retained austenite, wherein, based on a t/4 point where t is a steel sheet thickness, the ferrite has an average grain size of 2 μm or less, and an average value of a ratio of a ferrite length in a rolling direction of a steel sheet with respect to a length of the ferrite in a thickness direction of the steel sheet is 1.5 or less.

2. The cold rolled steel sheet of claim 1, further comprising: 15 to 50% of bainite in an area fraction.

3. The cold rolled steel sheet of claim 1, wherein the martensite is composed of tempered martensite and fresh martensite, wherein a proportion of the tempered martensite in the martensite exceeds 50 area %.

4. The cold rolled steel sheet of claim 1, wherein the ferrite is contained in an amount of 3 to 15% by area fraction.

5. The cold rolled steel sheet of claim 1, wherein the average value of a ratio is 0.5 or more.

6. The cold rolled steel sheet of claim 1, further comprising, by weight %, at least one of boron (B): 0.001-0.005% and titanium (Ti): 0.005-0.04%.

7. The cold rolled steel sheet of claim 1, wherein the aluminum (Al) is contained in an amount of 0.01 to 0.09% by weight.

8. The cold rolled steel sheet of claim 1, wherein the chromium (Cr) is contained in an amount of 0.01 to 0.7% by weight.

9. The cold rolled steel sheet of claim 8, wherein the chromium (Cr) is contained in an amount of 0.2 to 0.6% by weight.

10. The cold rolled steel sheet of claim 1, wherein the molybdenum (Mo) is contained in an amount of 0.02 to 0.08% by weight.

11. The cold rolled steel sheet of claim 1, further comprising: a tensile strength of 1180 MPa or more, an elongation of 14% or more, and a hole expansion ratio (HER) of 25% or more.

12. The cold rolled steel sheet of claim 11, wherein the hole expansion ratio (HER) is 30% or more.

13. The cold rolled steel sheet of claim 1, further comprising: an alloyed hot-dip galvanized layer disposed on a surface of the cold rolled steel sheet.

14. A method of manufacturing the cold rolled steel sheet of claim 1, the method comprising:

cold rolling a steel material, and then, heating the steel material until the steel material is completely transformed into austenite, the steel material including, by weight %, carbon (C): 0.13 to 0.25%, silicon (Si): 1.0 to 2.0%, manganese (Mn): 1.5 to 3.0%, aluminum (Al)+chromium (Cr)+molybdenum (Mo): 0.08 to 1.5%, phosphorus (P): 0.1% or less, sulfur(S): 0.01% or less, nitrogen (N): 0.01% or less, and a balance of Fe and unavoidable impurities, slowly cooling the heated steel material at a cooling rate of 5 to 12° C./s to a slow cooling stop temperature of 630 to 670° C., and then maintaining the slow cooling stop temperature for 10 to 90 seconds, rapidly cooling the slow-cooled steel material at a cooling rate of 7 to 30° C./s to a temperature range of a martensitic transformation end temperature (Mf) or more and a martensitic transformation start temperature (Ms) or less, and partitioning treating by maintaining the rapidly-cooled steel material for 300 to 600 seconds at a temperature exceeding the martensitic transformation start temperature (Ms) and a bainite transformation start temperature (Bs) or less.

15. The method of claim 14, wherein the steel material further comprises, by weight %, at least one of boron (B): 0.001-0.005% and titanium (Ti): 0.005-0.04%.

16. The method of claim 14, wherein the aluminum (Al) is contained in the steel material in an amount of 0.01 to 0.09% by weight.

17. The method of claim 14, wherein the chromium (Cr) is contained in the steel material in an amount of 0.01 to 0.7% by weight.

18. The method of claim 14, wherein the chromium (Cr) is contained in the steel material in an amount of 0.2% to 0.6% by weight.

19. The method of claim 14, wherein the molybdenum (Mo) is contained in the steel material in an amount of 0.02 to 0.08% by weight.

20. The method of claim 14, further comprising:

forming a hot-dip galvanized layer on a surface of the cold rolled steel sheet and performing alloy processing thereon.

* * * * *